US005458246A

United States Patent [19]

Thom, Jr.; Kelsey C.

[11] Patent Number: 5,458,246

[45] Date of Patent: Oct. 17, 1995

[54] HORIZONTAL CYLINDRICAL SIFTER WITH ADJUSTABLE AGITATOR ARMS

[75] Inventor: Kelsey C. Thom, Jr., Cedar Falls, Iowa

[73] Assignee: Roskamp Champion, Waterloo, Iowa

[21] Appl. No.: 315,537

[22] Filed: Sep. 30, 1994

[51] Int. Cl.[6] ..... B07B 1/20

[52] U.S. Cl. ..... 209/300; 209/389

[58] Field of Search ..... 209/300, 306, 209/384, 389

[56] References Cited

U.S. PATENT DOCUMENTS

| | | | |
|---|---|---|---|
| 15,455 | 7/1856 | Mendenhall et al. | 209/300 X |
| 1,571,736 | 2/1926 | Reed et al. | 209/300 X |
| 2,293,668 | 8/1942 | Shankel | 209/300 X |
| 4,638,954 | 1/1987 | Poss | 209/300 X |

*Primary Examiner*—D. Glenn Dayoan

*Attorney, Agent, or Firm*—Robert F. Palermo; Michael H. Minns

[57] ABSTRACT

A horizontal cylindrical sifter is provided, including a housing with an inlet for feed material of mixed size at a first end, an outlet for coarse material at a second end, a cylindrical screen for sifting the mixed feed material to separate the coarse material from fine material mixed therewith, the screen extending from the inlet to the outlet of the housing and having a rotatably driven shaft extending along an axial centerline of the cylindrical screen, agitator arms extending substantially radially outwardly from the rotatably driven shaft and having mounted at outer radial extremities of the arms agitator blades for rabbling the mixed feed material on the screen, and the improvement, in combination with the sifter, which provides for adjusting the agitator arms to alter an angular orientation of the agitator blades.

3 Claims, 3 Drawing Sheets

HORIZONTAL CYLINDRICAL SIFTER WITH ADJUSTABLE AGITATOR ARMS

BACKGROUND OF THE INVENTION

This invention relates generally to sifters for separating coarse and fine feed materials and more particularly to an improvement to such sifters allowing adjustment of agitator blades to accommodate different feed materials and different size distributions of such materials.

Current horizontal cylindrical sifters have non-adjustable agitator blades usually fixed to non-adjustable arms and oriented axially within the cylindrical screen of the sifter. Such fixed blades can handle some product capacities better than others at a given speed. Although performance and capacity can be improved by speed adjustments, it is not economical to change speed for different products. The result may be rotor speed which is too high and which causes product overflow and high fines content in the sifted product.

Operation of a typical horizontal cylindrical sifter includes feeding the ground grain material having a full distribution of particle sizes into the inlet of the sifter housing. The mixture lands on the cylindrical screen where it is rabbled or stirred by agitator blades attached by agitator arms to a rotating shaft longitudinally disposed within the screen. The stirring action allows the fine particles to separate from the coarse particles and to fall through the screen into a fines chamber surrounding the screen in the sifter housing. The coarse particles are retained on the screen and, due to the displacement action of new mixed material entering the sifter inlet, is discharged through the coarse particle outlet. Depending on the properties of the material being processed, straight longitudinal orientation of the agitator blades may be most efficient at a given rotor speed. However, there are many cases in which this will not be so and in which it may be necessary to provide some additional driving force to move the coarse particles to the outlet. Co-current blowers or other air conveyors have the disadvantage of moving fines faster than coarse particles to the outlet, thereby defeating the sifting operation. Countercurrent blowers are much harder to control and to balance the elutriative effect on fines, which may cause rejection of fines out through the inlet.

The foregoing illustrates limitations known to exist in present horizontal cylindrical sifters, and it would be advantageous to provide an alternative directed to overcoming one or more of those limitations. Accordingly, a suitable alternative is provided including features more fully disclosed hereinafter.

SUMMARY OF THE INVENTION

In one aspect of the present invention, a horizontal cylindrical sifter is provided, including a housing with an inlet for feed material of mixed size at a first end, an outlet for coarse material at a second end, a cylindrical screen for sifting the mixed feed material to separate the coarse material from fine material mixed therewith, the screen extending from the inlet to the outlet of the housing and having a rotatably driven shaft extending along an axial centerline of the cylindrical screen, agitator arms for extending substantially radially outwardly from the rotatably driven shaft and having mounted at outer radial extremities of the arms agitator blades for rabbling the mixed feed material on the screen, the improvement, in combination with the sifter, comprising means for adjusting the agitator arms to alter an angular orientation of the agitator blades.

The foregoing and other aspects of the invention will become apparent from the following detailed description, when considered in conjunction with the accompanying drawings.

DETAILED DESCRIPTION

Figure 1:
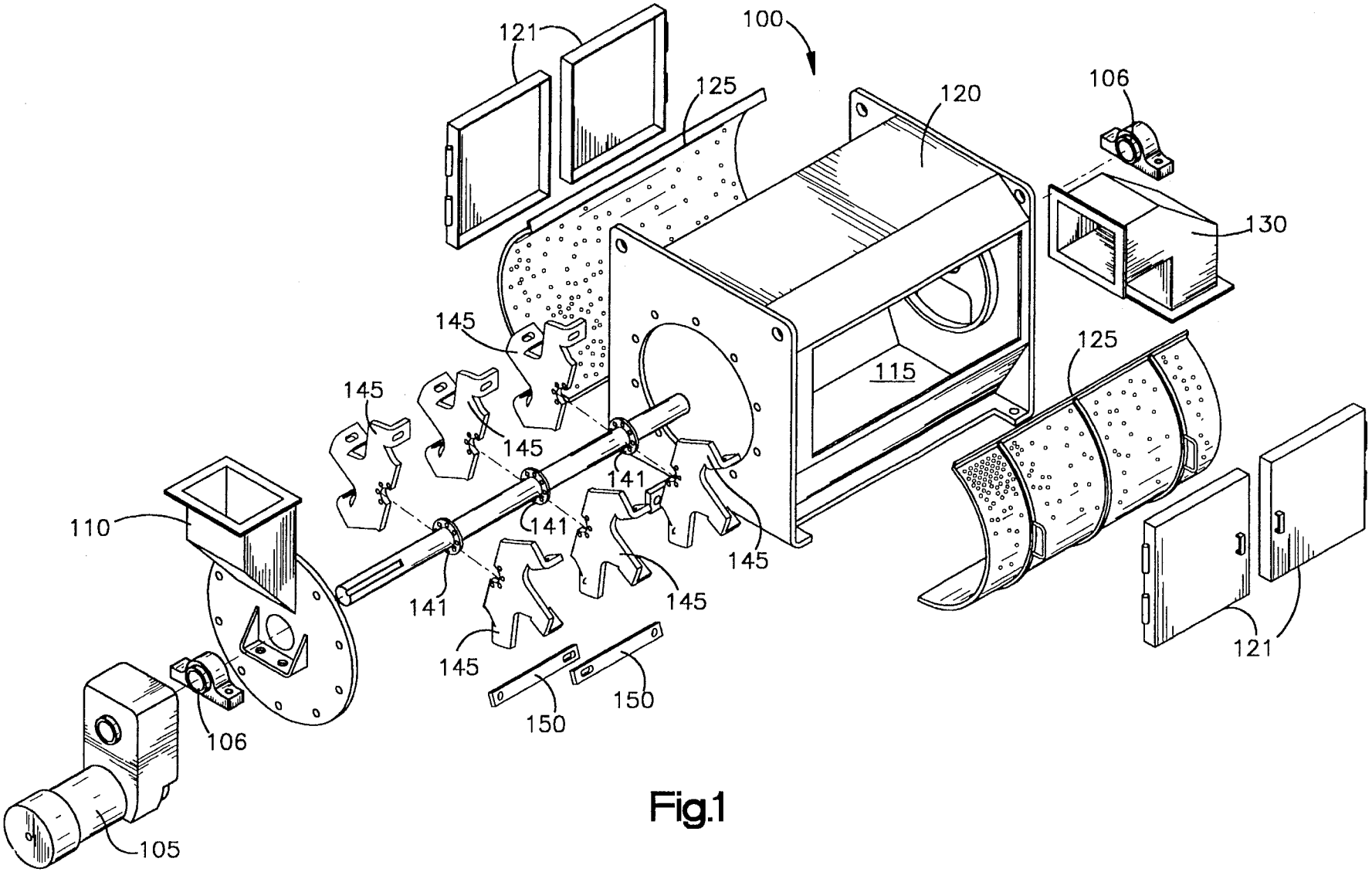
FIG. 1 is an exploded perspective schematic view illustrating an embodiment of a horizontal cylindrical sifter incorporating the agitator blade static adjustment feature of the present invention.

The exploded view in FIG. 1 shows the several components which make-up one of the simpler embodiments of the horizontal cylindrical sifter 100 of the present invention. Housing 120 has a fines chamber 115 indicated in the bottom thereof, a cylindrical screen 125 for mounting within the housing above the fines chamber, doors 121 for providing access to the screen and fines chamber, an inlet 110 at a first end, and an outlet 130 at a second end. Rotor shaft 140 is longitudinally disposed within housing 120, has a plurality of flanges 141 fixed at intervals along its length, and is rotatably supported by bearings 106. A motor 105 provides rotative power to drive rotor shaft 140. The agitator arms 145 are shown in two pieces and are seen to have hole patterns which match the hole patterns of flanges 141. By this means, it is easily seen that arms 145 can be fastened to flanges 141 in many different positions. Agitator blades 150 are attached to the ends of arms 145 which define the orientation of the blades by their positions on the flanges 141. Blades 150 may be oriented parallel to the shaft 140 or inclined to the shaft in a leading or trailing "quasi-helical" orientation.

In order to adjust the blades 150, the sifter must be turned off, the doors 121 opened, screen 125 removed, blade fasteners loosened or removed, and arm 145- to -flange 141 fasteners removed as needed. The arms 145 are re-positioned, as desired, and re-fastened to the flanges 141. Blade fasteners are re-installed and re-tightened to complete adjustment of the blades 150. The screen 125 and doors 121 are reinstalled and secured, and the sifter is ready for operation. This static adjustment embodiment has the disadvantage of requiring shut-down for each change and, as a consequence, the inability to fine adjust sifter action during operation. This may result in operating at less than optimum efficiency.

Figure 2:
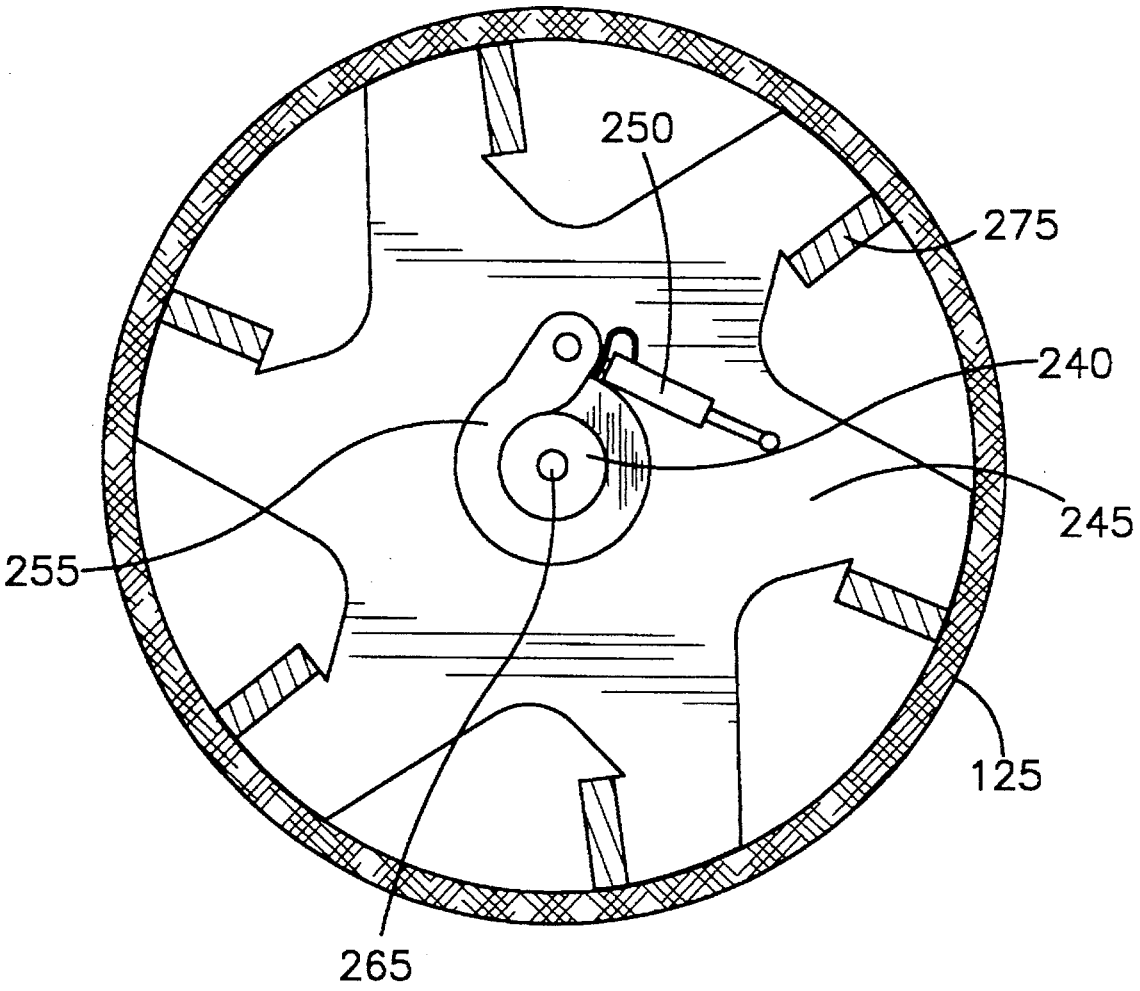
FIG. 2 is an end elevation schematic view showing an alternative agitator blade fluid powered dynamic adjuster.
Figure 3:
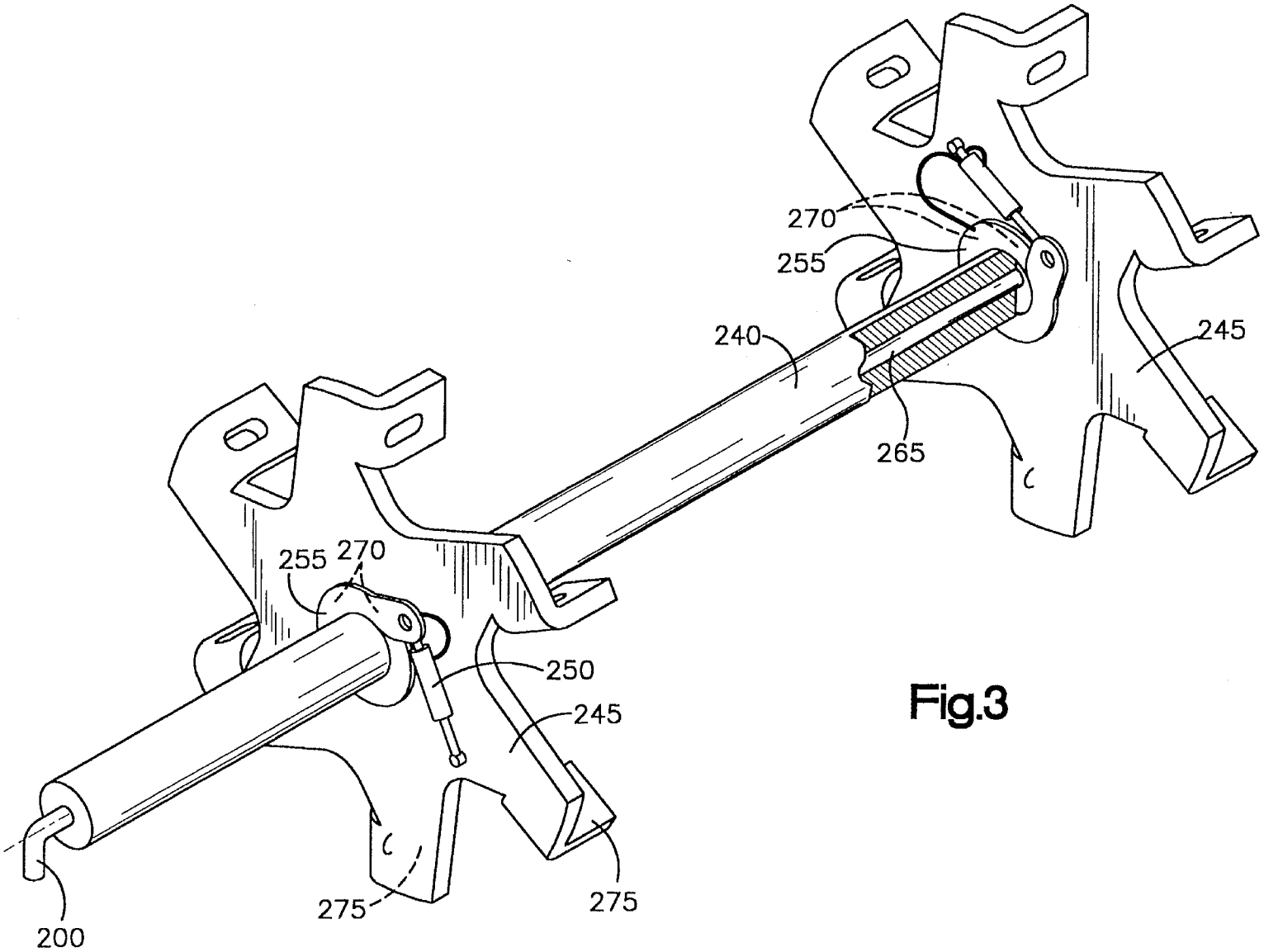
FIG. 3 is a schematic fragmentary partially sectional view illustrating a possible fluid power path into the fluid power cylinders to provide agitator blade dynamic adjustment.

FIG. 2 shows an alternative adjustment scheme which can be operated when the sifter is running, thereby enabling continuous operation at peak efficiency. In this case, screen 125 is shown surrounding a single piece agitator arm 245 with blades 275 mounted on its outer extremities. A collar 255 is rigidly attached to shaft 240 adjacent to agitator arm 245 which has a snug fit thereto but is capable of being rotated with respect to shaft 240. Fluid power cylinder 250 provides a connection between arm 245 and collar 255 to control their relative positions. Referring to FIG. 3 in conjunction with FIG. 2, operation of the adjustment features can easily be understood. The blades are excluded from FIG. 3 for clarity, but the purpose of fluid channel 265, extending the length of shaft 240, is more clearly revealed. Fluid pressure is supplied through rotating fluid fitting 200 into channel 265. Beneath each collar 255 is at least one fluid port 270 extending through the wall of shaft 240. Each collar 255 has a fluid channel for communication between ports 270 and fluid power cylinder 250. Thus, when supplied with fluid pressure, cylinder 250 extends and agitator arm 245 rotates clockwise (left arm FIG. 3) or counterclockwise (right arm FIG. 3) with respect to collar 255 and shaft 240, depending on the orientation of cylinder 250, collar 255, and arm 245, as shown. Generally, if only two agitator arms are being used as shown in FIG. 3, the adjustment can be accomplished with only one movable arm and one fixed one rather than with two arms movable in opposite directions as shown. This is especially true if a double-acting fluid power cylinder is used; because then the arm may be caused to move in either direction with respect to the collar.

What is claimed is:

1. In a horizontal cylindrical sifter having a housing with an inlet for feed material of mixed size at a first end, an outlet for coarse material at a second end, a cylindrical screen for sifting the mixed feed material to separate the coarse material from fine material mixed therewith, said screen extending from said inlet to said outlet of said housing and having a rotatably driven shaft extending along an axial centerline of said cylindrical screen, agitator arms for extending substantially radially outwardly from said rotatably driven shaft and having mounted at radial extremities of said arms agitator blades for rabbling said mixed feed material on said screen, the improvement, in combination with said sifter, comprising:

means for adjusting said agitator arms to alter an angular orientation of said agitator blades, the means for adjusting said agitator arms including a hydraulic operator.

2. In a horizontal cylindrical sifter having a housing with an inlet for feed material of mixed size at a first end, an outlet for coarse material at a second end, a cylindrical screen for sifting the mixed feed material to separate the coarse material from fine material mixed therewith, said screen extending from said inlet to said outlet of said housing and having a rotatably driven shaft extending along an axial centerline of said cylindrical screen, agitator arms for extending substantially radially outwardly from said rotatably driven shaft and having mounted at radial extremities of said arms agitator blades for rabbling said mixed feed material on said screen. the improvement, in combination with said sifter, comprising:

means for adjusting said agitator arms to alter an angular orientation of said agitator blades, the means for adjusting said agitator arms comprising a collar securely attached to said rotatably driven shaft and having orifices for providing fluid communication between pressurized fluid flowing through a longitudinal bore in said rotatably driven shaft and a fluid power cylinder extending between said collar and said agitator arm rotatably clamped adjacent to said collar such that said arm moves in response to extension or contraction of said fluid power cylinder.

3. In a horizontal cylindrical sifter having a housing with an inlet for feed material of mixed size at a first end, an outlet for coarse material at a second end, a cylindrical screen for sifting the mixed feed material to separate the coarse material from fine material mixed therewith, said screen extending from said inlet to said outlet of said housing and having a rotatably driven shaft extending along an axial centerline of said cylindrical screen, agitator arms for extending substantially radially outwardly from said rotatably driven shaft and having mounted at radial extremities of said arms agitator blades for rabbling said mixed feed material on said screen, the improvement, in combination with said sifter, comprising:

means for adjusting said agitator arms to alter an angular orientation of said agitator blades, the means for adjusting said agitator arms to alter an angular orientation of said agitator blades being operable both when the sifter is running and when it is idle.

* * * * *